US010500478B2

(12) United States Patent
Kurita

(10) Patent No.: US 10,500,478 B2
(45) Date of Patent: Dec. 10, 2019

(54) SWAYING TOY

(71) Applicant: EPOCH COMPANY, LTD., Tokyo (JP)

(72) Inventor: Nobuaki Kurita, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 15/788,986

(22) Filed: Oct. 20, 2017

(65) Prior Publication Data

US 2018/0111044 A1 Apr. 26, 2018

(30) Foreign Application Priority Data

Oct. 24, 2016 (JP) ..... 2016-207654

(51) Int. Cl.
*A63F 9/00* (2006.01)
*A63F 9/28* (2006.01)
*A63F 7/24* (2006.01)

(52) U.S. Cl.
CPC ..... *A63F 9/28* (2013.01); *A63F 7/24* (2013.01); *A63F 7/249* (2013.01)

(58) Field of Classification Search
CPC ..... A63F 9/26; A63F 9/28; A63F 7/24; A63F 7/249
USPC ..... 273/109, 118 R, 120 R, 121 B, 276, 281, 273/282.3, 447, 449, 450
See application file for complete search history.

(56) References Cited

U.S. PATENT DOCUMENTS 2,458,306 A 1/1949 Schneider
3,402,929 A * 9/1968 Glass ..... A63H 15/04 273/447
3,559,989 A * 2/1971 Breslow ..... A63F 9/26 273/109
3,578,320 A * 5/1971 Goldfarb ..... A63F 7/02 273/120 R
3,589,724 A * 6/1971 Barlow ..... A63F 9/0076 273/440

(Continued)

FOREIGN PATENT DOCUMENTS

CN Y-2794580 7/2006
CN Y-201150789 11/2008

(Continued)

OTHER PUBLICATIONS

DE Office Action dated May 25, 2018 from corresponding German patent application No. 1102017124831.5 (with attached English-language translation).

(Continued)

*Primary Examiner* — Joseph B Baldori
(74) *Attorney, Agent, or Firm* — Drinker Biddle & Reath LLP

(57) ABSTRACT

A swaying toy includes: a grounding-position-variable base member; a tubular tower member erected from the base member; a ball placing member which allows a ball to be placed thereon; and a piece placing member including a piece placing portion which allows a piece to be placed thereon and a ball-hit portion to be hit by the ball. The piece placing member is swingably attached to the tower member. The ball is released from the ball placing member according to a grounding state of the base member and passes through an inside space of the tower member.

9 Claims, 7 Drawing Sheets

(56) References Cited

U.S. PATENT DOCUMENTS

| | | | | | |
|---|---|---|---|---|---|
| 3,610,628 | A * | 10/1971 | Promin | A63F 7/042 | 273/120 R |
| 3,614,106 | A * | 10/1971 | Morrison | A63F 9/26 | 273/156 |
| 3,785,647 | A * | 1/1974 | Bender | A63F 9/26 | 273/450 |
| 3,973,774 | A * | 8/1976 | Breslow | A63B 65/12 | 124/33 |
| 4,087,090 | A * | 5/1978 | Goldberg | A63F 7/02 | 273/412 |
| 4,358,110 | A * | 11/1982 | Youkstetter | A63F 9/26 | 273/450 |
| 4,522,403 | A * | 6/1985 | Maciorowski | A63F 9/0811 | 273/154 |
| 5,197,735 | A * | 3/1993 | Land | A63F 9/04 | 273/144 R |
| 5,240,260 | A | 8/1993 | Strongin | | |
| 5,954,340 | A | 9/1999 | Tedesco | | |
| 6,318,726 | B1 * | 11/2001 | Nicholls | A63F 7/0076 | 273/449 |
| 7,819,404 | B2 * | 10/2010 | Creech | A63F 3/00 | 273/241 |
| 7,874,560 | B1 * | 1/2011 | Dean | A63F 9/26 | 273/450 |
| 8,196,927 | B2 * | 6/2012 | Marantz | A63F 5/02 | 273/138.3 |
| 8,366,571 | B2 * | 2/2013 | Walker, Jr. | A63B 67/10 | 473/506 |
| 8,403,327 | B2 * | 3/2013 | Fischer | A63F 7/02 | 273/144 R |
| 8,864,137 | B2 * | 10/2014 | Ritter | A63F 9/30 | 273/440 |
| 9,199,160 | B2 * | 12/2015 | Bazarko | A63F 3/00261 | |
| 2006/0091604 | A1 * | 5/2006 | Sargent | A63F 3/00145 | 273/241 |
| 2006/0220314 | A1 | 10/2006 | Chung | | |
| 2014/0110902 | A1 * | 4/2014 | Thompson | A63F 9/26 | 273/450 |

FOREIGN PATENT DOCUMENTS

| | | | |
|---|---|---|---|
| DE | 8621625 | U1 | 10/1986 |
| GB | 1046315 | A | 10/1966 |
| JP | H04-50075 | Y2 | 11/1992 |
| JP | H04-53830 | Y2 | 12/1992 |
| JP | H05-25670 | Y2 | 6/1993 |
| JP | H05-27987 | Y2 | 7/1993 |

OTHER PUBLICATIONS

CN Office Action dated Aug. 3, 2018 in Chinese Application No. 201711003825.9.

* cited by examiner

SWAYING TOY

CROSS-REFERENCE TO RELATED APPLICATION(S)

This application is based on and claims priority from Japanese Patent Application No. 2016-207654 filed on Oct. 24, 2016, the entire contents of which are incorporated herein by reference.

BACKGROUND

1. Field of the Invention

One or more embodiments of the present invention relate to a swaying toy.

2. Description of Related Art

In swaying toys, a structural body such as a tower is disposed on a base that has a spherical bottom surface and that are placed on a desk or the like to allow users to play with them by swaying them. For example, JP-Y2-H05-025670 discloses a swaying toy in which a tower is erected from a base and ring-shaped piece placing portions are attached to the outside circumferential surface of the tower. In this swaying toy, a plurality of users place pieces on the piece placing portions at desired positions in order. If pieces fall off the swaying toy when a certain user has placed a piece, this user loses.

JP-Y2-H05-027987 discloses a swaying toy in which a mountain-shaped structural body is formed on a base and formed with, like terraced fields, flat portions on which to place pieces. JP-Y2-H04-053830 discloses a swaying toy in which a tower that is disposed on a base is formed with a plurality of hanging pieces from which pieces are to hang. JP-Y2-H04-050075 discloses a swaying toy in which if a tower formed on a base loses balance, the tower falls in such a manner as to be divided into left and right halves to cause placed pieces to fall off.

SUMMARY

In the above-described swaying toys, pieces drop or a structural body on a base operates as the structural body sways. However, there are users who desire an action that is even larger in scale.

An object of one or more embodiments of the present invention is to provide a swaying toy in which its action caused when it sways and thereby loses balance provides even more amusement than in the related art.

A swaying toy according to an aspect of the invention includes: a grounding-position-variable base member; a tubular tower member erected from the base member; a ball placing member on which a ball is placed; and piece placing members each having a piece placing portion to be placed with a piece and a ball-hit portion to be hit by the ball, wherein the piece placing members are attached swingably to the tower member and the ball is released from the ball placing member according to a grounding state of the base member and passes through an inside space of the tower member.

According to one or more embodiments of the present invention, the swaying toy performs an action that the ball is moved to scatter pieces due to a sway of the swaying toy. As such, the swaying toy can provide even more amusement than in the related art.

DETAILED DESCRIPTION

Figure 1:
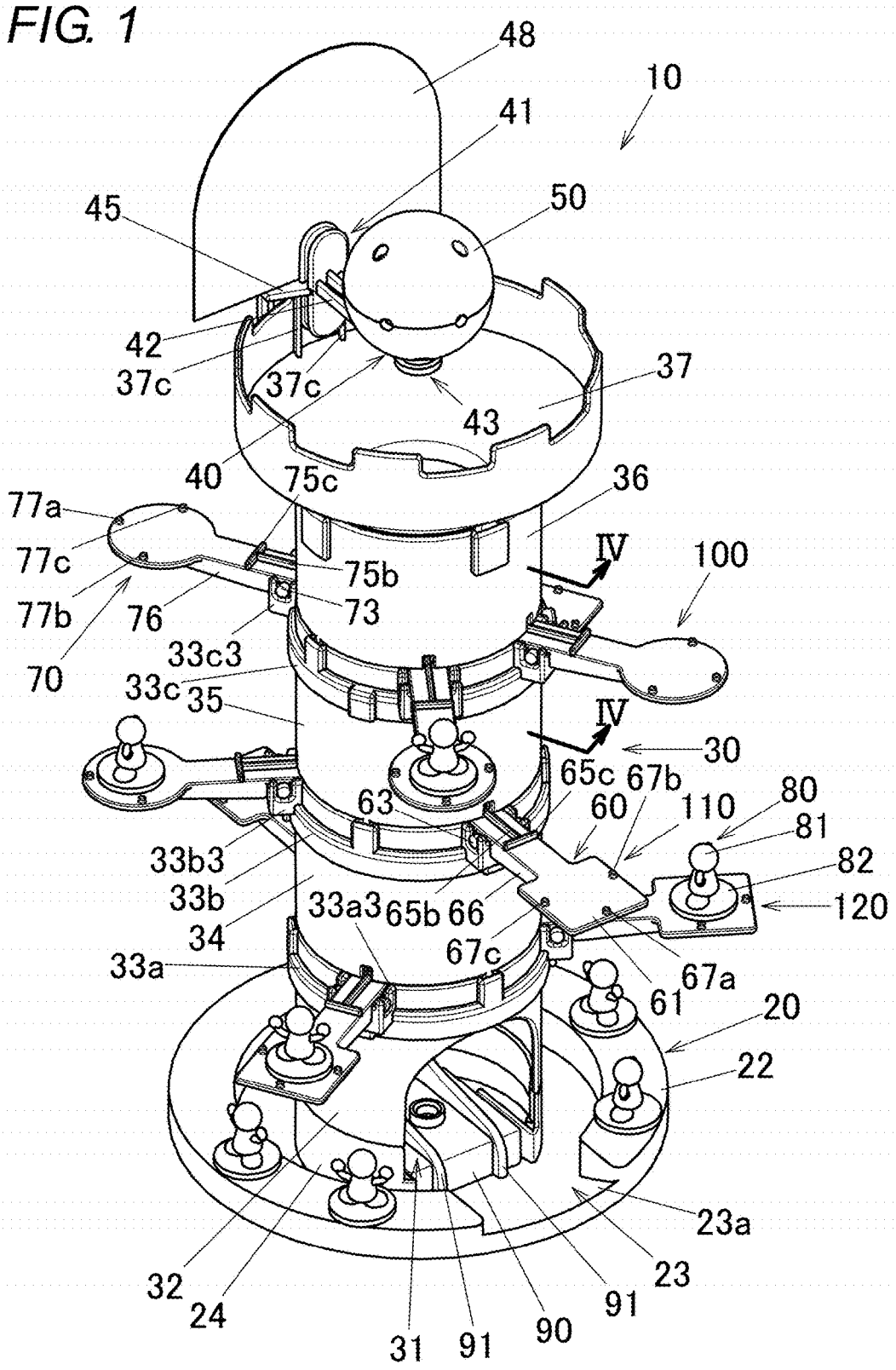
FIG. 1 is a perspective view, as view from above, of a swaying toy according to an embodiment of the present invention.

An embodiment of the present invention will be hereinafter described with reference to the drawings. A swaying toy 10 shown in FIGS. 1 and 2 includes: a base member 20 which has a substantially dish shape and which includes a spherical bottom surface; an substantially cylindrical tower member 30 which is erected from the base member 20; and a ball placing member 40 on which a ball 50 can be placed. A plurality of piece placing members 60 and 70 are swingably attached to the circumferential wall of the tower member 30. On each of the piece placing members 60 and 70, a piece 80 including a main body 81 which is a human-like figure and a disc-shaped bottom plate 82 can be placed.

To play with the swaying toy 10, for example, a plurality of users put pieces 80 in order on the piece placing members 60 and 70. During that course, the swaying toy 10 sways according to the balance of arrangement of the pieces 80. If the swaying toy 10 is inclined to a large extent, the ball 50 placed on the ball placing member 40 drops into the tower member 30, whereby the ball 50 hits ball-hit portions 62 and 72 (described later) of the respective piece placing members 60 and 70 to lift up piece placing portions 61 and 71 (described later) of the piece placing members 60 and 70 quickly and thereby scatter pieces 80 if they are placed thereon. A user who caused the scattering of the pieces 80 loses.

Figure 2:
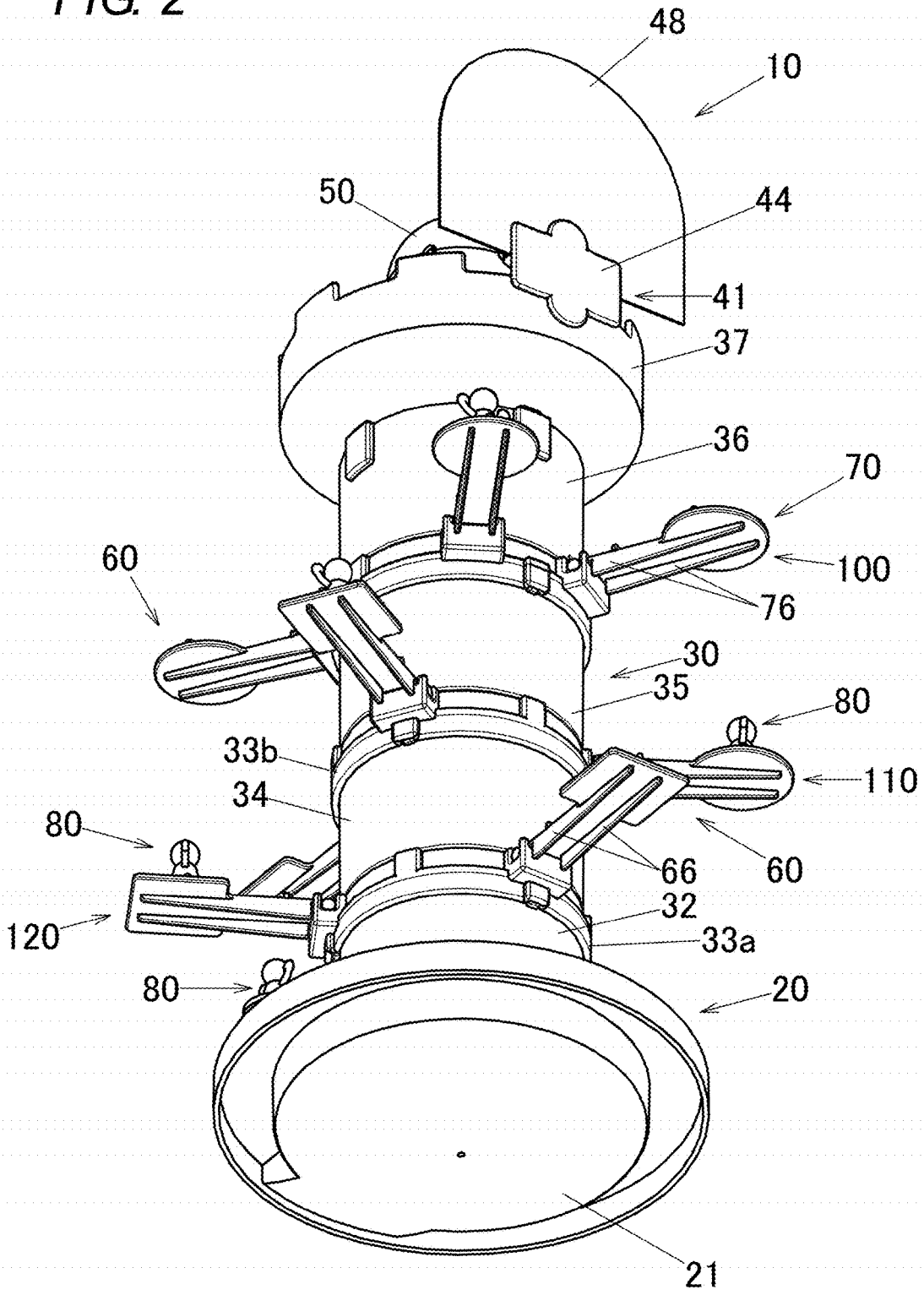
FIG. 2 is a perspective view, as view from below, of the swaying toy according to the embodiment of the present invention.

Next, the configuration of the individual members of the swaying toy 10 will be described below in detail. As shown in FIG. 2, the bottom surface of the base member 20 includes a variably grounding portion 21 having a spherically convex bottom surface. The position of the bottom surface of the variably grounding portion 21, which contacts a placement surface such as a desk surface, varies as the swaying toy 10 sways.

As shown in FIG. 1, the top surface of the base member 20 is recessed in the area corresponding to the variably grounding portion 21 and the outer rim of the recess defines a piece placing wall 22 which is like a C-shaped ring. Pieces 80 may be placed on the piece placing wall 22 in advance. The C-ring-shaped piece placing wall 22 has a cut that serves as a ball ejection portion 23. The ball ejection portion 23 has a slant surface 23*a* which is inclined downward toward the center of the base member 20. Thus, the ball 50 that goes out through a ball ejection hole 31 of the tower member 30 (described later) is ejected from the swaying toy 10 smoothly.

A ball ejection member 90 is fixed to the center of the top surface of the base member 20. The ball ejection member 90 is located inside the substantially cylindrical tower member 30, and can receive the ball 50 falling from above. The top surface of the ball ejection member 90 is formed with two rib-shaped ball ejection guides 91. The ball ejection guides 91 are inclined downward outward, that is, toward the ball ejection portion 23. Thus, the ball 50 received by the ball ejection guides 91 is guided to the ball ejection portion 23 through the ball ejection hole 31. A weight (not shown) is provided inside each ball ejection guide 91, whereby the swaying toy 10 is prevented from falling easily.

The substantially cylindrical tower member 30 is erected from the base member 20 substantially at the center. The tower member 30 is an assembly of plural cylindrical members (bottom cylinder 32, first middle cylinder 34, second middle cylinder 35, top cylinder 36, and introducing member 37) and intermediate rings (connection rings 33*a*, 33*b*, and 33*c*) which are fixed to each other. A tower base portion 24 which is shaped like a C-shaped ring is erected from the top surface of the base member 20 outside the ball ejection member 90. The lowest, bottom cylinder 32 is fixed to the tower base portion 24. A cut of the C-ring-shaped tower base portion 24 and a side opening of the bottom cylinder 32 constitute the ball ejection hole 31.

The bottom cylinder 32 is connected, via the connection ring 33*a*, to the first middle cylinder 34 which is located above the bottom cylinder 32. The first middle cylinder 34 is connected, via the connection ring 33*b*, to the second middle cylinder 35 which is located above the first middle cylinder 34. Furthermore, the second middle cylinder 35 is connected, via the connection ring 33*c*, to the top cylinder 36 which is located above the second middle cylinder 3. The top cylinder 36 is connected to the introducing member 37 which is located above the top cylinder 36 and increases in diameter upward like a cone. The introducing member 37 can guide the ball 50 released from the ball placing member 40 to the center axis of the tower member 30.

Figure 3:
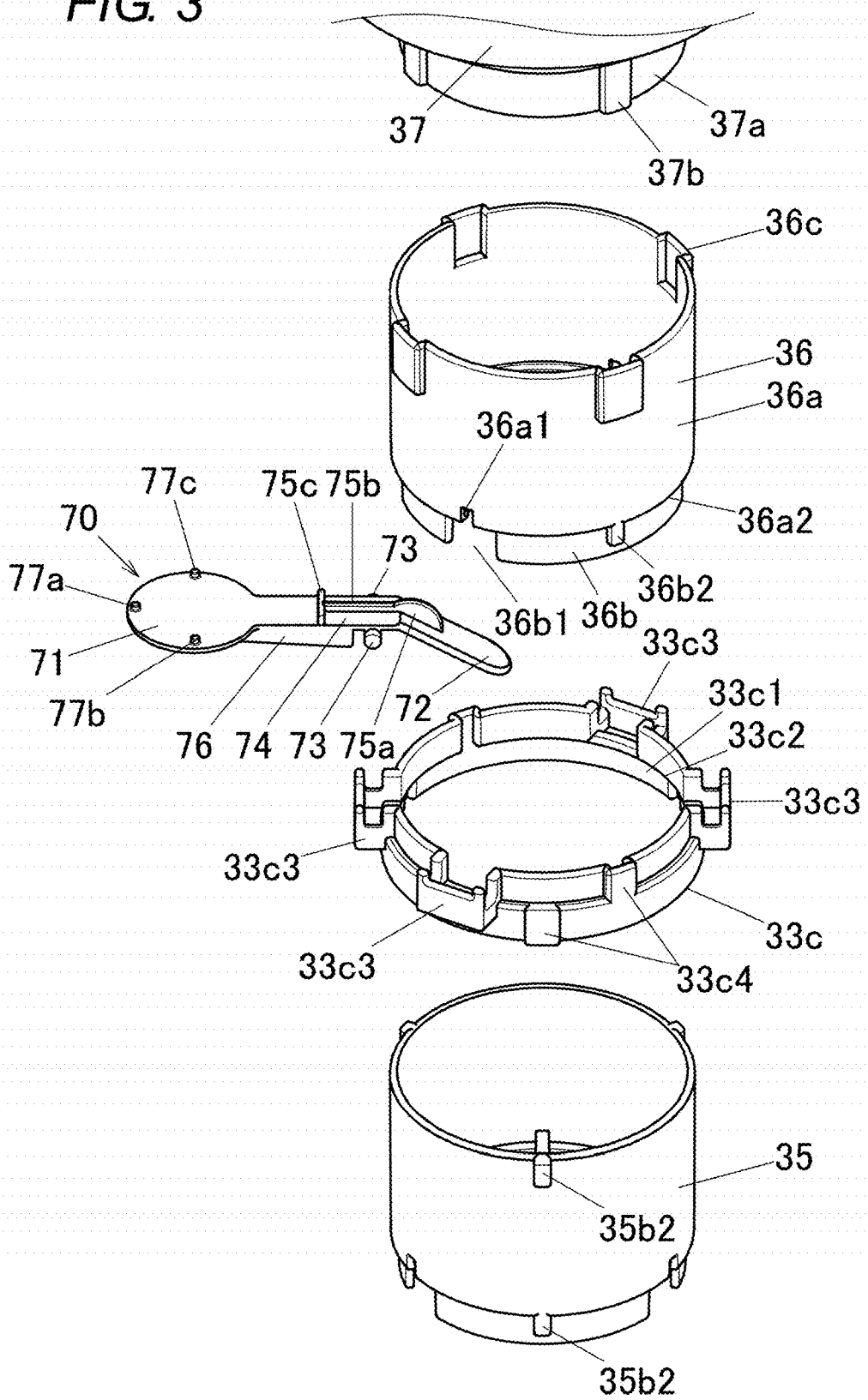
FIG. 3 is an exploded perspective view of part of a tower member (an introducing member, a top cylinder, a connection ring, and a second middle cylinder) and one piece placing member of the swaying toy according to the embodiment of the present invention.

As shown in FIG. 3, the top cylinder 36 includes, under a cylinder body 36*a*, a narrow portion 36*b* which is smaller in diameter than the cylinder body 36*a*. The narrow portion 36*b* has cuts 36*b*1 which correspond to respective supporting-point support portions 33*c*3 (described later) of the connection ring 33*c* which is connected to the top cylinder 36 from below. The cylinder body 36*a* has, on the cuts 36*b*1, cut grooves 36*a*1 which communicate with the respective cuts 36*b*1. The narrow portion 36*b* is fitted in the connection ring 33*c*, and a step surface 36*a*2 as a boundary between the cylinder body 36*a* and the narrow portion 36*b* is in contact with the top surface of the connection ring 33*c*. The top cylinder 36 is fixed to the connection ring 33*c* in this manner.

The connection ring 33*c*, on a lower end thereof, includes a wide portion 33*c*1 which is larger in diameter; and a step surface 33*c*2. A top portion of the second middle cylinder 35 is fitted in the wide portion 33*c*1, and the top surface of the second middle cylinder 35 is in contact with the step surface 33*c*2. Thus, the second middle cylinder 35 is fixed to the connection ring 33*c*. In the above-described manner, a connection structure is formed in which the top cylinder 36 and the second middle cylinder 35 are connected to the connection ring 33*c*.

The connection ring 33*c* includes supporting-point support portions 33*c*3 at four positions radially in a top view. Four sets of a cut 36*b*1 and a cut groove 36*a*1 are formed so as to correspond to the four respective supporting-point support portions 33*c*3.

A connection structure in which the bottom cylinder 32 and the first middle cylinder 34 are connected to the connection ring 33*a* and a connection structure in which the first middle cylinder 34 and the second middle cylinder 35 are connected to the connection ring 33*b* are similar to the above connection structure in which the top cylinder 36 and the second middle cylinder 35 are connected to the connection ring 33*c*. Each of the connection rings 33*a* and 33*b* is formed with three supporting-point support portions 33*a*3 or 33*b*3. Similar to the supporting-point support portions 33*c*3 of the connection ring 33*c*, the three supporting-point support portions 33*a*3 or 33*b*3 are arranged radially in a top view.

A top portion of the top cylinder 36 is formed with, at four positions, radially in a plan view, lock recesses 36*c* which project outward from the inner circumferential surface. On the other hand, the introducing member 37 has, as a bottom portion, a cylindrical insertion portion 37*a*, and the outer circumferential surface of the insertion portion 37*a* is formed with, at four positions, lock projections 37*b* which project outward and correspond to the respective lock recesses 36*c*. The lock projections 37*b* are inserted in the respective lock recesses 36*c*, whereby the introducing member 37 is fixed to the top cylinder 36.

The circumferential position, with respect to the top cylinder 36, of the introducing member 37 to which the ball placing member 40 is attached can be changed in units of 90°. Thus, before a start of a game, the swaying toy 10 can be adjusted so as to stand substantially vertically by changing the circumferential position of the top cylinder 36.

Each of the bottom cylinder 32, the first middle cylinder 34, the second middle cylinder 35, and the top cylinder 36 includes lock projections (denoted by, for example, symbol 35*b*2 or 36*b*2 in FIG. 3). Each of the connection rings 33*a*, 33*b*, and 33*c* has lock recesses (denoted by, for example, symbol 33*c*4 in FIG. 3) at positions corresponding to the associated lock projections (denoted by symbol 35*b*2 or 36*b*2, for example). The lock projections (denoted by symbol 36*b*2, for example) are locked on the respective lock recesses (denoted by symbol 36*c*4, for example), whereby the cylinders 32, 34, 35, and 36 and the connection rings 33*a*-33*c* are prevented from rotating in the circumferential direction.

Next, the structure of each of the piece placing members 60 and 70 which are attached to the tower member 30 swingably will be described below. Since each piece placing member 60 and each piece placing member 70 are different from each other only in the shapes of piece placing portions 61 and 71, the piece placing member 70 shown in FIG. 3 will be described below.

The piece placing member 70 includes a disc-shaped piece placing portion 71 and a ball-hit portion 72 on the two respective sides of a supporting-point portion 73. The ball-hit portion 72 is to be hit by the ball 50 falling inside the tower member 30. The piece placing portion 71 and the ball-hit portion 72 are connected to each other by a flat-plate-like connection plate 74. The supporting-point portion 73 is formed in such a manner that end portions of a shaft project from the bottom surface of the connection plate 74 to the two respective sides in its width direction. The ball-hit portion 72 is inclined downward from the connection plate 74. The top surface of the ball-hit portion 72 includes a vertical rib 75*a* which is arc-shaped when viewed from the side. The top surface of the connection plate 74 is formed with a top surface reinforcement rib 75*b* which is continuous with the vertical rib 75*a* and extends in the longitudinal direction of the piece placing member 70.

The top surface of the piece placing member 70 is formed with, near the boundary between the piece placing portion 71 and the connection plate 74, a restriction rib 75*c* which extends in the width direction. The bottom surface of the piece placing member 70 is formed with, at two positions in the width direction, swing restriction ribs 76 which extend in the longitudinal direction under the piece placing portion 71 and the connection plate 74 (also see FIG. 2). The top surface of the piece placing portion 71 is formed with a projection 77*a* at a tip position and with projections 77*b* and 77*c* near end positions in the width direction.

Figure 4:
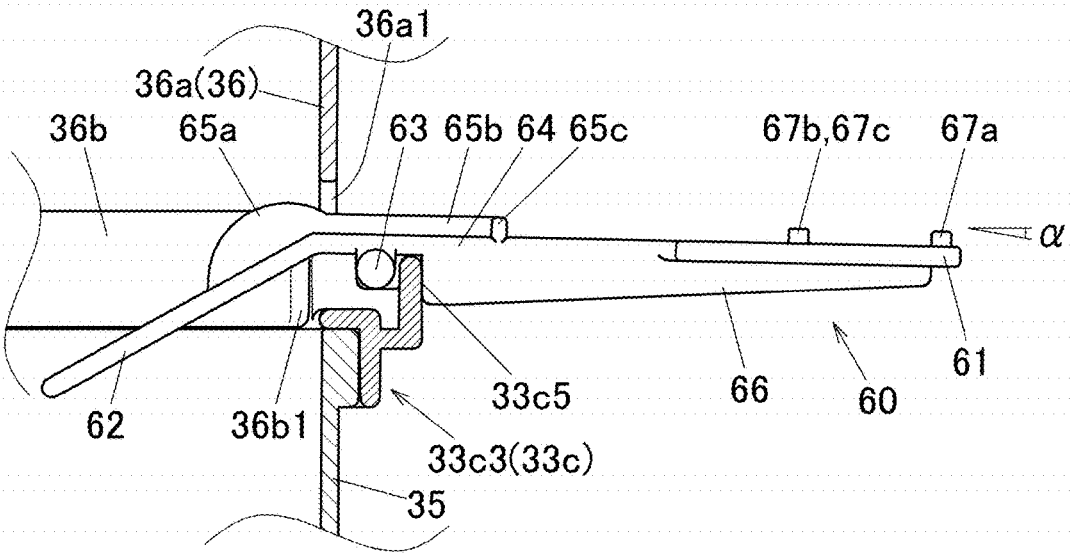
FIG. 4 is a sectional view of part of FIG. 1 taken along line IV-IV in FIG. 1 and shows part of the tower member (the top cylinder, the connection ring, and the second middle cylinder) and a piece placing member of the swaying toy according to the embodiment of the present invention.

Similar to the piece placing member 70, the piece placing member 60 includes a square-plate-like piece placing portion 61, a ball-hit portion 62, a supporting-point portion 63, a connection plate 64, a vertical rib 65*a*, a top surface reinforcement rib 65*b*, a restriction rib 65*c*, swing restriction ribs 66, and projections 67*a*, 67*b*, and 67*c* (see FIG. 4).

Next, a structure by which each of the piece placing members 60 and 70 is supported by the tower member 30 will be described below. Since each piece placing member 60 and each piece placing member 70 are supported by the tower member 30 by the same structure, a structure shown in FIG. 4 in which each piece placing member 60 is supported by the top cylinder 36 and the connection ring 33*c* will be described as an example. FIG. 4 is a sectional view of part of FIG. 1 taken along line IV-IV in FIG. 1.

As shown in FIG. 4, in the piece placing member 60, the shaft of the supporting-point portion 63 is supported swingably by a supporting-point support portion 33*c*3. A cut 36*b*1 of the top cylinder 36 exists on the supporting-point support portion 33*c*3, whereby an upward movement of the piece placing member 60 is restricted. A cut groove 36*a*1 (see FIG. 3) prevents the vertical rib 65*a* from interfering with the cylinder body 36*a*. Thus, the piece placing member 60 can be inserted after connection of the top cylinder 36 and the connection ring 33*c*, which increases the ease of assembling.

In a steady state, the back surfaces of the swing restriction ribs 66 are in contact with an outer side surface 33*c*5 of the supporting-point support portion 33*c*3, whereby a clockwise swing about the supporting-point portion 63 (in other words, a downward swing of the piece placing portion 61; see FIG. 4) is restricted. In the steady state shown in FIG. 4, the piece placing portion 61 is inclined downward by an angle α (substantially equal to 2° to 3°) from a horizontal plane in side view. Thus, where a piece 80 is placed on the piece placing portion 61, the piece 80 is somewhat inclined outward with respect to the tower member 30. In the above-described manner, the ball-hit portions 62 and 72 of the piece placing members 60 and 70 are disposed inside the substantially cylindrical tower member 30 and their piece placing portions 61 and 71 are disposed outside the tower member 30.

On the piece placing portion 61, the bottom plate 82 of the piece 80 can come into contact with the projection 67*a*, 67*b*, or 67*c*. Thus, the piece 80 is prevented from slipping and falling off the piece placing portion 61. Furthermore, since the bottom plate 82 of the piece 80 can come into contact with the restriction rib 65*c*, the piece 80 is prevented from moving to leave the piece placing portion 61 and reach the tower member 30.

Figure 6:
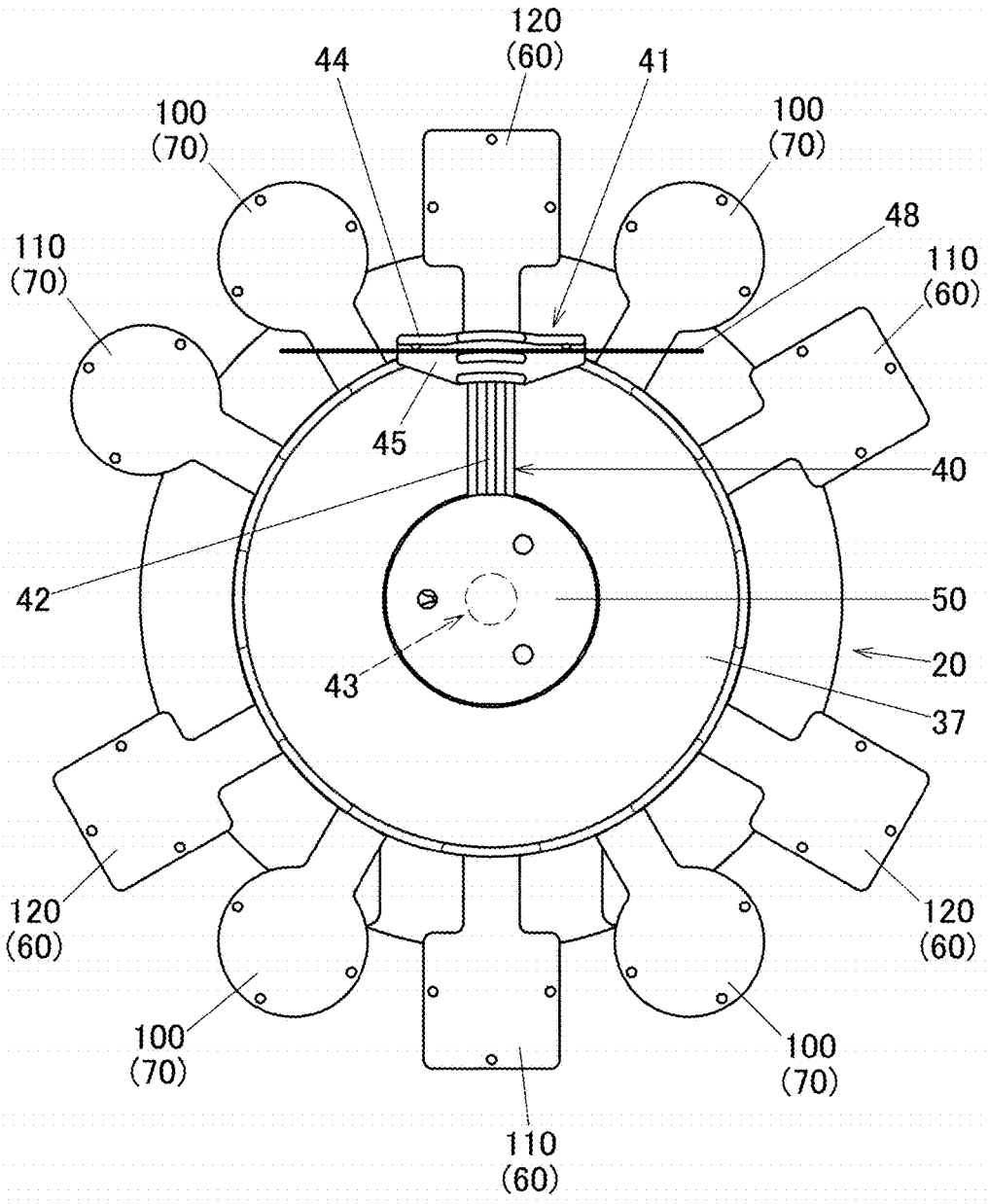
FIG. 6 is a top view of the swaying toy according to the embodiment of the present invention.

As mainly shown in FIG. 6 (also see FIGS. 1 and 2), four piece placing members 60, 70 are attached to the connection ring 33*c* to constitute a first piece placing member layer 100. Three piece placing members 60 and 70 are attached to the connection ring 33*b* to constitute a second piece placing member layer 110, and three piece placing members 60 are attached to the connection ring 33*a* to constitute a third piece placing member layer 120.

As shown in FIG. 6, no pair of piece placing members 60, 70 (piece placing portions 61, 71) overlap with each other in a top view. In other words, the second piece placing member layer 110 is located downstream of the first piece placing member layer 100 in the movement direction of the ball 50 (in the embodiment, top-to-bottom direction) and the piece placing members 60, 70 of the second piece placing member layer 110 are disposed at positions not corresponding to positions where the piece placing members 60, 70 of the first piece placing member layer 100 are disposed.

Likewise, the third piece placing member layer 120 is located downstream of the second piece placing member layer 110 in the movement direction of the ball 50 and the piece placing members 60, 70 of the third piece placing member layer 120 are disposed at positions not corresponding to positions where the piece placing members 60, 70 of the first piece placing member layer 100 and the piece placing members 60, 70 of the second piece placing member layer 110 are disposed. Thus, even if a piece 80 placed on any piece placing member 60 or 70 is thrown up, it is prevented from hitting another piece placing member 60 or 70.

Figure 7:
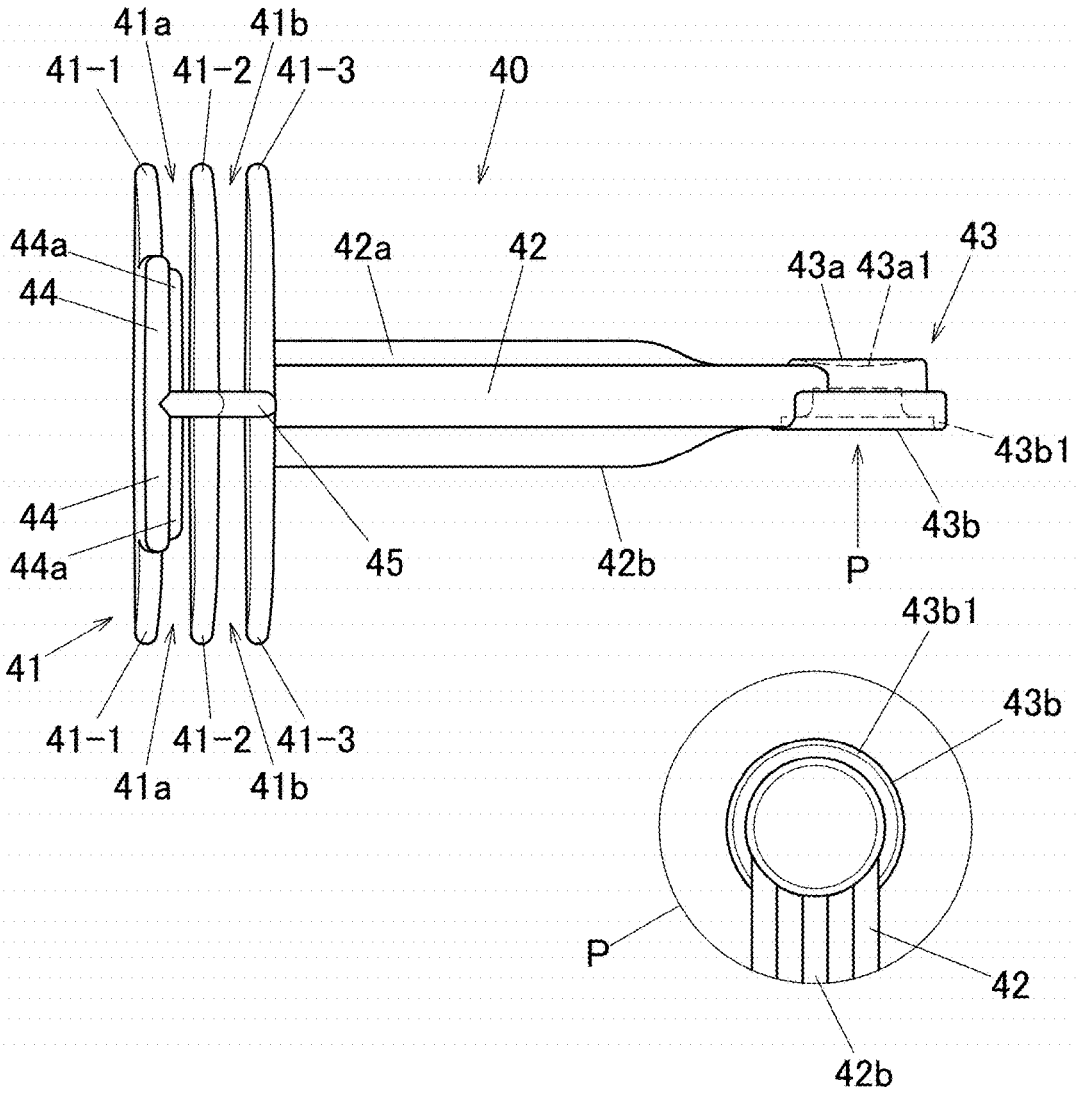
FIG. 7 is a side view of a ball placing member of the swaying toy according to the embodiment of the present invention.

The ball placing member 40 is disposed at the top of the tower member 30 (i.e., at the top of the introducing member 37). As shown in FIG. 7, a base portion 41 of the ball placing member 40 is formed with two (top and bottom) pairs of slits 41*a* and 41*b* into which a portion of the circumferential wall of the introducing member 37 is to be inserted. The two pairs of slits 41*a* and 41*b* are formed between three plates 41-1, 41-2, and 41-3 which extend in the width direction thereof. The ball placing member 40 is attached to the introducing member 37 in such a manner that the portion of the circumferential wall of the introducing member 37 is inserted into one of the slits 41*a* and 41*b* while two side portions of the plate 41-2 or 41-3 of the base portion 41 are guided by respective insertion guides 37*c* (see FIG. 1) which are formed on the inner surface of the circumferential wall of the introducing member 37 and extend in the top-bottom direction.

The swaying toy 10 can be adjusted so as to stand substantially vertically before a start of a game by selecting one of the slits 41*a* and 41*b*. It is preferable that after this adjustment the swaying toy 10 be adjusted further by changing the position of the introducing member 37 to which the ball placing member 40 is attached in the above-described manner.

A horizontal plate 45 is formed at the boundary between the top slits 41*a* and 41*b* and the bottom slits 41*a* and 41*b* so as to extend in the width direction perpendicularly to the three plates 41-1, 41-2, and 41-3. When the portion of the circumferential wall of the introducing member 37 is inserted into one of the slits 41*a* and 41*b*, the horizontal plate 45 comes into contact with the top edge of the introducing member 37. A beam-like portion 42 which is H-shaped in cross section extends from the base portion 41 inward (i.e., toward the center axis of the tower member 30 (introducing member 37)). A central groove portion, H-shaped in cross section, of the beam-like portion 42 is formed with a top reinforcement rib 42*a* and a bottom reinforcement rib 42*b*. A roughly cylindrical ball support portion 43 whose axis extends in the top-bottom direction is continuous with the tip of the beam-like portion 42.

The ball support portion 43 is formed with a first ball support portion 43*a* and a second ball support portion 43*b* above and below as viewed in FIG. 7, respectively. A support surface 43*a*1 of the first ball support portion 43*a* is concave (in the embodiment, spherically concave). The ball 50 that is placed on the support surface 43*a*1 does not fall off even if the swaying toy 10 is inclined to some extent. On the other hand, as shown in the inset (as viewed from a direction P) of FIG. 7, the second ball support portion 43*b* is formed with a support ring 43*b*1 having a ring-shaped outer rim in plan view. The second ball support portion 43*b* is larger in diameter than the first ball support portion 43*a*. Thus, the second ball support portion 43*b* can support the ball 50 more stably than the first ball support portion 43*a* does.

By inserting the portion of the circumferential wall of the introducing member 37 into the bottom slit 41*a* or 41*b* or the top slit 41*a* or 41*b*, selection can be made of whether the ball 50 should be placed on the first ball support portion 43*a* or the second ball support portion 43*b*. In this manner, users can select between different degrees of difficulty of a game (i.e., stability of the support of the ball 50). More specifically, when the ball 50 is placed on the first ball support portion 43*a*, it falls off easily and hence a game is difficult. On the other hand, when the ball 50 is placed on the second ball support portion 43*b*, it does not fall off easily and hence a game is easy.

A bottom portion of a sheet 48 which is made of paper, for example, and on which a figure, a picture, or the like is drawn may be inserted into the top slit 41*a* of the base portion 41 that is attached to the introducing member 37. In this case, the sheet 48 is held between the plate 41-2 located between the slits 41*a* and 41*b* and a pair of projections 44*a* which are formed on the front surfaces of sheet support plates 44 which extend in the width direction from the back plate 41-1 of the slits 41*a*. Thus, the sheet 48 can be held reliably.

How the above-configured swaying toy 10 operates will be described below. First, as mentioned above, plural users put pieces 80 on piece placing portions 61 and 71 of piece placing members 60 and 70 in order. During that course, the swaying toy 10 sways according to the manner of arrangement of placed pieces 80 including pieces 80 placed on the piece placing wall 22. If the swaying toy 10 loses balance and is inclined to a large extent, the ball 50 is released from the ball placing member 40 and guided toward the center axis of the swaying toy 10 by the introducing member 37.

Figure 5:
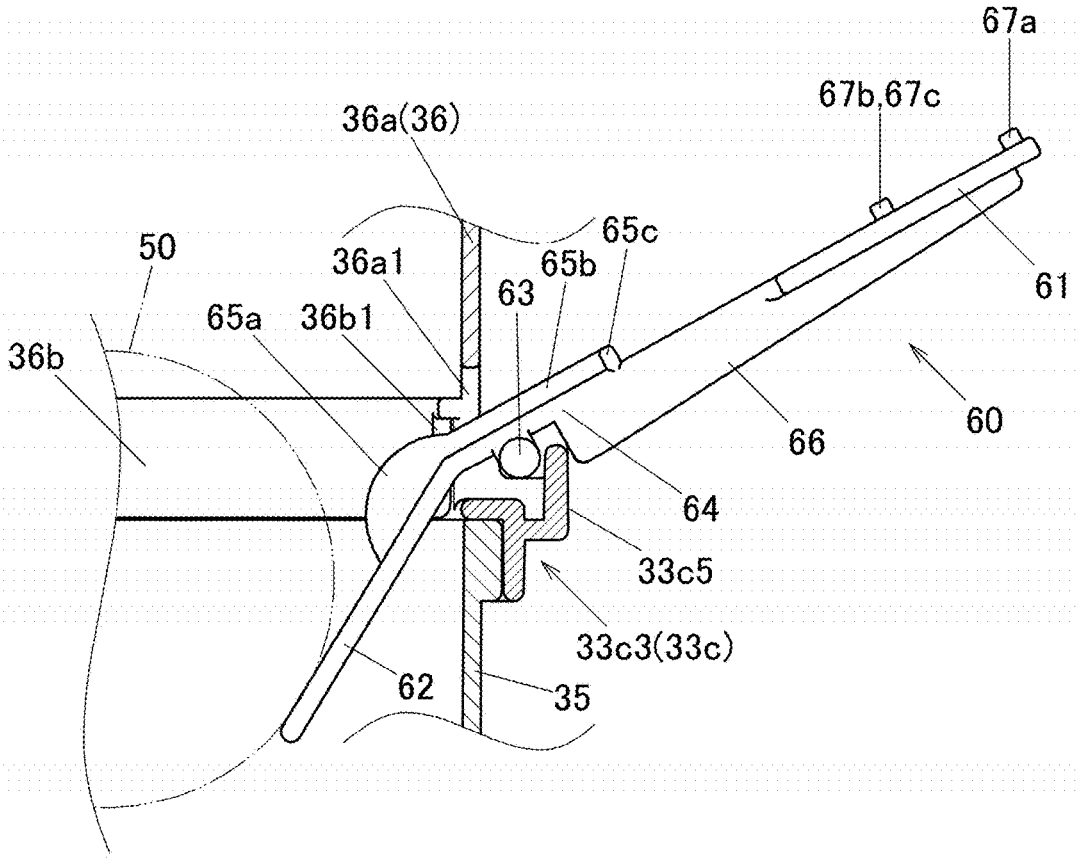
FIG. 5 is a sectional view corresponding to FIG. 4 and shows part of the tower member (the top cylinder, the connection ring, and the second middle cylinder) and the piece placing member of the swaying toy according to the embodiment of the present invention to illustrate how the piece placing member acts when its ball-hit portion is hit by a ball.

The ball 50 that has been guided toward the center axis of the swaying toy 10 falls (passes) through the inside space of the tower member 30. As shown in FIG. 5, as the ball 50 falls, the ball 50 hits the ball-hit portion 62 (72) of each piece placing member 60 (70) and the piece placing member 60 (70) is swung about the supporting-point portion 63 (73). More specifically, the ball-hit portion 62 (72) is pushed down and the piece placing portion 61 (71) is elevated. As a result, the piece 80 that is placed on the piece placing portion 61 (71) is thrown up outside the tower member 30.

The falling ball 50 is guided by the vertical rib 65*a* (75*a*) of the piece placing member 60 (70) so as to fall along the center axis of the tower member 30. Since the vertical rib 65*a* (75*a*) is moved downward together with the ball 50, the degree of weakening of the momentum of the falling ball 50 is made lower than in a case that a similar vertical rib is fixed to the inside surface of the tower member 30.

Whereas the four piece placing members 60 (70) are arranged in the first piece placing member layer 100, the three piece placing members 60 and 70 are arranged in the second piece placing member layer 110 and the three piece placing members 60 are arranged in the third piece placing member layer 120. When the ball 50 hits the ball-hit portion 62 (72) of a piece placing member 60 (70), part of the potential-energy-converted kinetic energy of the ball 50 is consumed. Thus, more of the kinetic energy of the ball 50 is consumed as the number of piece placing members 60 and/or 70 that are hit by the ball 50 at a time increases. Setting the number of placing members 60 and/or 70 smaller in the lower layers than in the upper layer in the above-described manner therefore allows even the ball 50 part of whose kinetic energy has been consumed in the upper layer to throw up pieces 80 arranged in the lower layers faster.

As described above, one or more embodiments of the invention can provide the following swaying toys according to various modes.

According to a first aspect, there is provided a swaying toy including: a grounding-position-variable base member; a tubular tower member erected from the base member; a ball placing member which allows a ball to be placed thereon; and a piece placing member including a piece placing portion which allows a piece to be placed thereon and a ball-hit portion to be hit by the ball, wherein the piece placing member is swingably attached to the tower member, and wherein the ball is released from the ball placing member according to a grounding state of the base member and passes through an inside space of the tower member.

With this configuration, pieces are placed on piece placing members in order and the swaying toy sways during that course, whereby the ball is released from the ball placing member. The released ball hits the ball-hit portions of the respective piece placing members to lift up the piece placing portions of the respective piece placing members quickly and thereby throw up pieces fast if they are placed thereon. Enabling the action of scattering pieces in addition to the sway action, this configuration makes it possible to provide a swaying toy capable of providing increased amusement.

In a swaying toy according to a second aspect, the ball placing member is disposed at a top of the tower member, and a bottom end portion of the tower member includes a ball ejection portion through which the ball is ejected.

With this configuration, the ball falls from the top of the swaying toy, whereby it is possible to provide a swaying top that does not require motive power such as produced by a motor.

A swaying toy according to a third aspect includes: a first piece placing member layer in which a plurality of piece placing members are arranged radially; and a second piece placing member layer which is disposed downstream of the first piece placing member layer in a movement direction of the ball and in which a plurality of piece placing members are disposed at positions not corresponding to positions where the piece placing members of the first piece placing member layer are disposed.

This configuration lowers the probability that a piece that is thrown up from the second piece placing member layer hits a piece placing member of the first piece placing member layer located upper than the second piece placing member.

In a swaying toy according to a fourth aspect, the number of piece placing members arranged in the first piece placing member layer is larger than the number of piece placing members arranged in the second piece placing member layer.

With this configuration, although the ball hits the piece placing members of the second piece placing member layer in a state that its kinetic energy was decreased due to hitting of the piece placing members of the first piece placing member layer, the ball can scatter the pieces in the second piece placing member layer properly because it loses smaller kinetic energy in the second piece placing member layer than in the first piece placing member layer.

In a swaying toy according to a fifth aspect, the piece placing member is attached such that a supporting-point portion is supported by the tower member, the ball-hit portion is disposed inside the tower member, and the piece placing portion is disposed outside the tower member and inclined downward from a horizontal plane.

With this configuration, since a piece placed on the piece placing member is inclined outward with respect to the tower member, the piece can be thrown outward when the ball hits the ball-hit portion. This lowers the probability that the piece thrown hits the tower member.

In a swaying toy according to a sixth aspect, the ball-hit portion is inclined downward, and the ball-hit portion is formed with a vertical rib that is arc-shaped in a side view.

With this configuration, the ball is guided to the center of piece placing members that are arranged radially. Thus, the ball can hit the piece placing members substantially uniformly and hence scatter the pieces placed thereon almost uniformly.

In a swaying toy according to a seventh aspect, the ball placing member includes: a beam portion that extends inward from a top edge of the tower member; and a ball support portion provided at a tip of the beam portion, the ball support portion includes a first ball support portion and a second ball support portion, and the second ball support portion supports the ball more stably than the first ball support portion.

Enabling selection between different degrees of stability of support of the ball, this configuration makes it possible to provide a swaying toy in which the difficulty of a game can be set according to users.

In a swaying toy according to an eighth aspect, the base member has a spherical bottom surface.

This configuration makes it possible to provide a swaying toy that sways smoothly.

In a swaying toy according to a ninth aspect, the base member has a substantially dish shape, and an edge portion of the base member has a piece placing surface which allows a piece to be placed thereon.

With this configuration, pieces that have not been placed on piece placing members yet can influence a sway operation of the swaying toy. This makes it possible to provide a swaying toy that provides greater entertainability of a game.

In a swaying toy according to a tenth aspect, the tower member includes: a plurality of tubular members; and an intermediate ring which supports a supporting-point portion of the piece placing member, and the intermediate ring is held between the tubular members.

This configuration makes it possible to provide a swaying toy that is simple in configuration and allows piece placing members to be disposed easily.

Although the embodiment of the invention has been described above, the invention is not limited to the embodiment and various modifications are possible without departing from the spirit and scope of the invention. For example, although the embodiment employs the substantially cylindrical tower member 30, the invention is not limited to this case and may employ a tubular tower member having any of other shapes.

Although in the embodiment the tower member 30 is erected vertically from the base member 20, the invention is not limited to this case; for example, a tower member is possible that has an intermediate loop or spiral passage. Although in the embodiment the variably grounding portion 21 of the base member 20 has a spherically convex bottom surface, the invention is not limited to this case; for example, a flat portion may be formed at the bottom, for example, to increase the stability of an upright posture of the swaying toy when it is in a neutral state. For another example, a variably grounding portion may be formed by combining many surfaces.

Furthermore, the tower member 30 may be implemented as a single component. Although in the embodiment the ball 50 is spherical, the invention may employ a ball having any of other shapes such as an ellipsoid and a polyhedron. Although in the embodiment pieces 80 are placed on piece placing members 60 and 70, the invention may employ any of other manners of placement of pieces such as hanging. Although in the embodiment the ball 50 is placed on the ball placing member 40, the invention may employ any of other manners of placement of a ball.

What is claimed is:

1. A swaying toy comprising:

a grounding-position-variable base member having a partially spherical bottom surface;

a tubular tower member erected from the base member and having an inside space, the inside space having an opening at a top of the tubular tower member;

a ball placing member disposed above the inside space of the tubular tower member, which allows a ball to be placed thereon; and a piece placing member comprising:

a piece placing portion which allows a piece to be placed thereon; and a ball-hit portion to be hit by the ball, wherein the piece placing member is swingably attached to the tower member such that a supporting-point portion is supported by the tower member, the ball-hit portion is disposed inside the tower member and being inclined downward relative to the piece placing portion beginning where the ball-hit portion enters the inside sa of the tower member, and the piece placing portion is disposed outside the tower member, wherein the ball is released from the ball placing member according to a grounding state of the base member, passes through the inside space of the tower member, hits the ball hit portion, and causes the piece placing portion to swing upward toward the ball placing member.

2. The swaying toy according to claim 1, wherein the ball placing member is disposed at a top of the tower member, and wherein a bottom end portion of the tower member comprises a ball ejection portion through which the ball is ejected.

3. The swaying toy according to claim 1, comprising:

a first piece placing member layer in which a plurality of piece placing members are arranged radially; and a second piece placing member layer which is disposed downstream of the first piece placing member layer in a movement direction of the ball and in which a plurality of piece placing members are disposed at positions not corresponding to positions where the piece placing members of the first piece placing member layer are disposed.

4. The swaying toy according to claim 3, wherein the number of piece placing members arranged in the first piece placing member layer is larger than the number of piece placing members arranged in the second piece placing member layer.

5. The swaying toy according to claim 1, wherein the piece placing portion is inclined downward from a horizontal plane.

6. The swaying toy according to claim 1, wherein the ball-hit portion is formed with a vertical rib that is arc-shaped in a side view.

7. The swaying toy according to claim 1, wherein the ball placing member comprises: a beam portion that extends inward from a top edge of the tower member; and a ball support portion provided at a tip of the beam portion, wherein the ball support portion comprises: a first ball support portion; and a second ball support portion, and wherein the second ball support portion supports the ball more stably than the first ball support portion.

8. The swaying toy according to claim 1, wherein the base member has a dish shape, and wherein an edge portion of the base member has a piece placing surface which allows a piece to be placed thereon.

9. The swaying toy according to claim 1, wherein the tower member comprises: a plurality of tubular members; and an intermediate ring which supports the supporting-point portion of the piece placing member, and wherein the intermediate ring is held between the tubular members.

* * * * *